US007265288B2

(12) United States Patent
Nishida et al.

(10) Patent No.: US 7,265,288 B2
(45) Date of Patent: Sep. 4, 2007

(54) KEY STRUCTURE

(75) Inventors: Kenichi Nishida, Hamamatsu (JP); Ichiro Osuga, Hamamatsu (JP); Yoichirou Shimomuku, Hamakita (JP)

(73) Assignee: Yamaha Corporation, Hamamatsu-shi (JP)

( * ) Notice: Subject to any disclaimer, the term of this patent is extended or adjusted under 35 U.S.C. 154(b) by 261 days.

(21) Appl. No.: 11/031,238

(22) Filed: Jan. 6, 2005

(65) Prior Publication Data

US 2005/0145093 A1 Jul. 7, 2005

(30) Foreign Application Priority Data

Jan. 6, 2004 (JP) ..... 2004-001236

(51) Int. Cl.
*G10C 3/12* (2006.01)

(52) U.S. Cl. ..... 84/433; 84/430; 84/431; 84/432; 84/452 R

(58) Field of Classification Search ..... 84/430–433, 84/452 R

See application file for complete search history.

(56) References Cited

U.S. PATENT DOCUMENTS 2,470,148 A * 5/1949 Demuth ..... 84/423 R
2,844,065 A * 7/1958 Corwin ..... 84/423 R
3,087,368 A * 4/1963 Lund ..... 84/423 R
3,120,146 A * 2/1964 Aubrey ..... 84/433
3,417,649 A * 12/1968 Wood ..... 84/433
3,616,722 A * 11/1971 Hochleitner ..... 84/354
3,738,216 A * 6/1973 Slaats et al. ..... 84/433
2004/0261598 A1* 12/2004 Uno et al. ..... 84/235
2005/0056138 A1* 3/2005 Osuga et al. ..... 84/433
2005/0145093 A1* 7/2005 Nishida et al. ..... 84/433

FOREIGN PATENT DOCUMENTS

JP 2003271127 9/2003
JP 2003271128 9/2003

* cited by examiner

*Primary Examiner*—Lincoln Donovan
*Assistant Examiner*—Robert W. Horn
(74) *Attorney, Agent, or Firm*—Morrison & Foerster LLP

(57) ABSTRACT

A key structure which is free from separation between a wood part thereof and a key base body to which the wood part is secured and has enhanced vertical rigidity in the vicinity of a clearance between the base end of the key base body and the wood part. In the key structure, the key base body has an extended part formed integrally with the base end and extended forward therefrom. The wood part is fixedly bonded to the upper surface of the extended part. A clearance is formed transversely of the key base body between the wood part and the base end. An upper plate body is fixedly bonded to both the upper surface of the wood part and the upper surface of the base end, and the rear part of the upper plate body extends in a manner spanning the base end and the wood part above the clearance.

9 Claims, 6 Drawing Sheets

KEY STRUCTURE

BACKGROUND OF THE INVENTION

1. Field of the Invention

The present invention relates to a key structure which is applied to a key having a wood part.

2. Description of the Related Art

Conventionally, key structures are known which function as a key pivotally moved by key depression and employ a wood part made of wood or the like as a part thereof, as disclosed in Japanese Laid-Open Patent Publications (Kokai) No. 2003-271127 (hereinafter referred to as the key structure according to first prior art) and No. 2003-271128 (hereinafter referred to as the key structure according to the second prior art). In such woody key structures, the wood part is provided at least for a so-called "visible part" which is visible from the outside during both performance and non-performance, so as to cause the key structure to present a woody appearance and a high-quality appearance. In the woody key structures, the wood part is supportably fixed e.g. using an adhesive to the lower surface of an upper plate body made of synthetic resin and having a playing or depressing surface, and to the upper surface of a key base body made of synthetic resin. The upper plate body and the key base body have elongated shapes corresponding to the shape of the key, and these support members and the wood part form the key structure.

However, the above key structures according to the first and second prior arts suffer from the following problem: The base end of the key base body is not in contact with the wood part in the longitudinal direction of the key structure, that is, each of the key structures has a clearance provided between the base end of the key base body and the wood part and extending transversely of the key structure, for accommodating a dimensional change due to an environmental change, such as changes in temperature and humidity, or a manufacturing error, and therefore the wood part is placed in a state supported only by the key base body in the vicinity of the clearance. This causes concentration of stress in the key base body in the neighborhood of the clearance e.g. when the key is depressed, which makes the wood part liable to separation from the key base body. Further, the whole key structure has low flexural rigidity.

Therefore, the conventional key structures still remain to be improved in durability and accuracy by preventing separation between the wood part and the key base body from being caused e.g. by key depression, and increasing the rigidity of the key structure. Particularly from the viewpoint of enhancement of the rigidity of the whole key structure, it is desired that not only the properties of the wood part which is deformed due to an environmental change, but also the properties of the synthetic resin-made upper plate body and key base body which are deformed due to molding thereof should be considered comprehensively.

SUMMARY OF THE INVENTION

It is an object of the present invention to provide a key structure which is free from separation between a wood part thereof and a key base body to which the wood part is secured and has enhanced vertical rigidity in the vicinity of a clearance between the base end of the key base body and the wood part.

To attain the above object, in a first aspect of the present invention, there is provided a key structure (K1 to K4, K14, K24, K34) that functions as a key when mounted in a keyboard apparatus, comprising a player-side end (K1*a*) that is pivotally moved by key depression, a key base body (20, 60, 80) that has an elongated shape, the key base body having a base end (21, 61, 81), and an extended part (22, 62, 82) formed integrally with the base end and extended therefrom toward the player, the extended part having an upper part (22*a*), a wood part (30) that is fixed to the upper part of the extended part of the key base body, in a manner such that a clearance (CL1) is formed transversely of the key base body between the wood part and the base end of the key base body, the wood part having an upper part (30*a*), an upper plate body (10, 40, 70, 170, 270) that is fixed to the upper part of the wood part, the upper plate body having a depressing surface (10*a*), and a connecting part (11, 41, 71, 171) that is located above the clearance, wherein the base end of the key base body and the upper plate body are fixedly connected to each other via the connecting part.

With the arrangement of the key structure according to the first aspect of the present invention, the base end of the key base body and the upper plate body are fixedly connected by the connecting part above the clearance. As a result, it is possible to prevent separation between the wood part and the key base body and enhance the vertical rigidity in the vicinity of the clearance between the base end of the key base body and the wood part.

Preferably, the extended part of the key base body has at least a part (22Br) thereof in a neighborhood of the clearance, the part being formed with a thickness smaller than a thickness of the connecting part.

Preferably, the connecting part and the extended part of the key base body have respective parts (41Br, 62Br) thereof in a neighborhood of the clearance, the part in the neighborhood of the clearance, of the connecting part having a vertical rigidity lower than a vertical rigidity of the part in the neighborhood of the clearance, of the extended part.

Preferably, the part in the neighborhood of the clearance, of the connecting part has an area (41Br2) that is not fixed to the base end of the key base body, the area having a length (L1) in a longitudinal direction of the key structure which is not less than a predetermined length according to a vertical thickness of the wood part.

Preferably, the connecting part has an opposed part (71*a*), and the base end of the key base body has an opposed part (81*a*) corresponding to the opposed part of the connecting part, the key base body, the upper plate body, and the connecting part being all formed of a synthetic resin, the wood part, the connecting part, the key base body, the upper plate body, and the connecting part being configured such that under a normal environment with normal temperature and normal humidity, when the connecting part (71) is fixed to the wood part, and at the same time the connecting part and the base end of the key base body are not fixed to each other, a vertical clearance (CL2) being formed between the opposed part of the connecting part and the opposed part of the base end, and when the opposed part of the connecting part and the opposed part of the base end are brought into a state fixed to each other, a tensile force (F1) that causes the opposed part of the connecting part to pull the opposed part of the base end is generated under the normal environment.

Preferably, the base end of the key base body and the connecting part are fixed to each other, the connecting part having formed therein through holes (11*a*, 11*b*, 11*c*) vertically extending through a portion of the connecting part fixed to the base end.

Preferably, the connecting part is formed integrally with the upper plate body.

Preferably, the connecting part is formed separately from the upper plate body.

To attain the above object, in a second aspect of the present invention, there is provided a key structure (K24) that functions as a key when mounted in a keyboard apparatus, comprising a player-side end that is pivotally moved by key depression, a key base body (80) that has an elongated shape, the key base body having a base end (81), and an extended part (82) formed integrally with the base end and extended therefrom toward the player, the extended part having an upper part, a wood part (30) that is fixed to the upper part of the extended part of the key base body, in a manner such that a clearance (CL1) is formed transversely of the key base body between the wood part and the base end of the key base body, the wood part having an upper part, an upper plate body (270) that is fixed to the upper part of the wood part, the upper plate body having a depressing surface (10*a*), and a connecting part (171) that is located rearward of the upper plate body and above the clearance, the connecting part being formed separately from the upper plate body, wherein the wood part and the base end of the key base body are fixedly connected to each other via the connecting part.

The above and other objects, features, and advantages of the invention will become more apparent from the following detailed description taken in conjunction with the accompanying drawings.

BRIEF DESCRIPTION OF THE DRAWINGS

FIGS. 5A to 5F are right side views of rear halves of key structures, which are useful in explaining the relationship between a dimensional change of wood parts thereof and reaction forces generated at respective bonded parts thereof in the neighborhood of clearances in the rear halves of the key structures, in which:

FIG. 5A shows a status of a key structure under a low humidity environment, which is configured such that the clearance is not formed under a normal environment;

FIG. 5B shows a status of the key structure under the normal environment;

FIG. 5C shows a status of the key structure under a high humidity environment;

FIG. 5D shows a status of the key structure (configured such that the clearance is formed under the normal environment) according to the fourth embodiment under the low humidity environment;

FIG. 5E shows a status of the key structure according to the fourth embodiment under the normal environment; and FIG. 5F shows a status of the key structure according to the fourth embodiment under the high humidity environment;

DETAILED DESCRIPTION OF THE PREFERRED EMBODIMENTS

The present invention will now be described in detail with reference to the drawings showing preferred embodiments thereof.

Figure 1A:
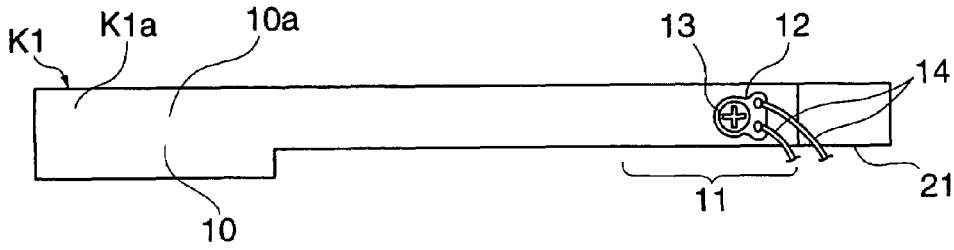
FIG. 1A is a plan view of a key structure according to a first embodiment of the present invention.
Figure 1B:
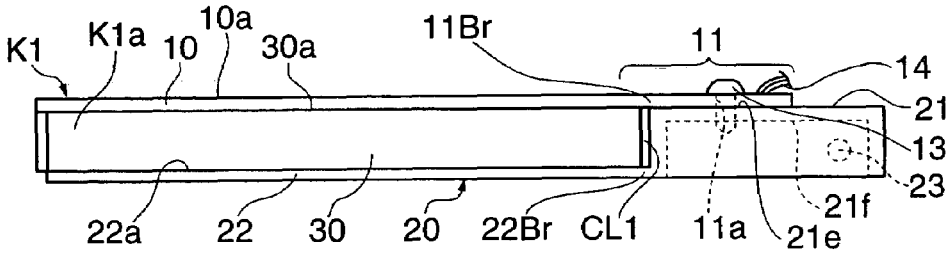
FIG. 1B is a right side view of the key structure.
Figure 1C:
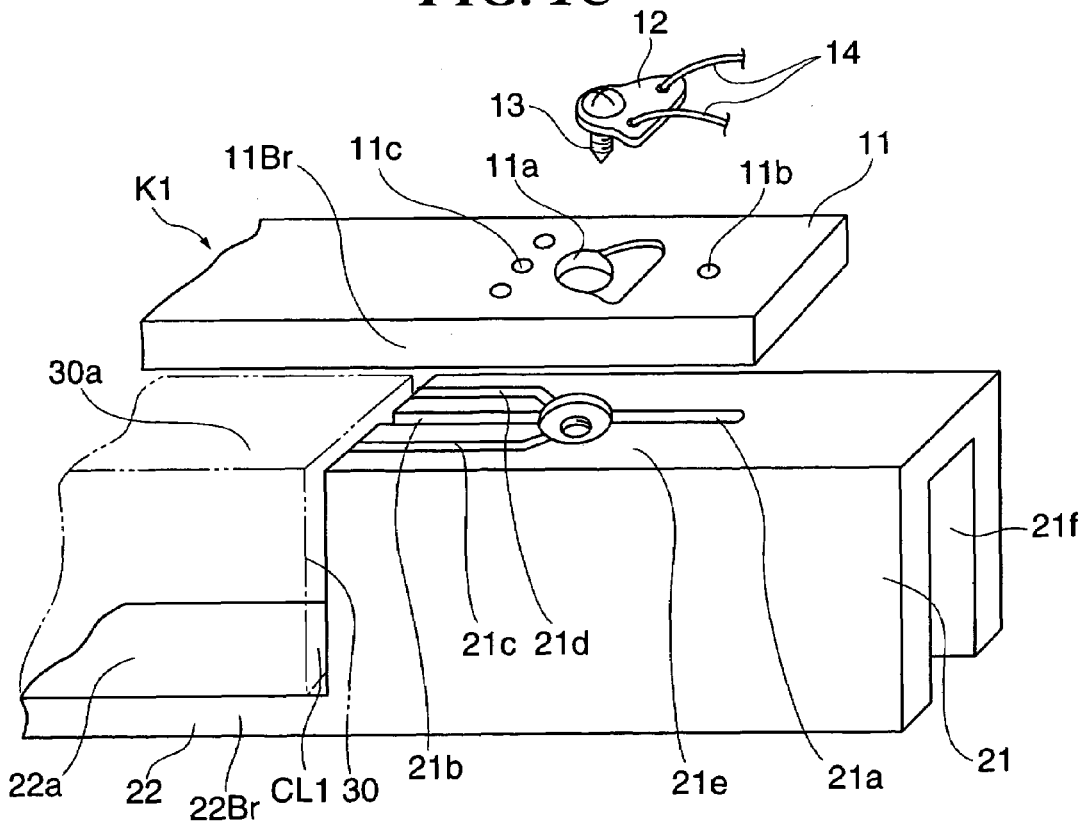
FIG. 1C is an exploded perspective view showing a rear part of the key structure.

FIG. 1A is a plan view of a key structure according to a first embodiment of the present invention. FIG. 1B is a right side view of the key structure, and FIG. 1C is an exploded perspective view showing a rear part of the key structure.

In the present embodiment, the key structure K1 is applied to a C key (white key for a pitch C), for example. The key structure K1 may be applied not only to a white key but also to a black key. In the following description, a side of the key structure K1 toward the player will be referred to as "the front side", and the right side of the same as viewed from the player will be referred to as "the right side". The key structure K1 is basically comprised of an upper plate body 10 and a key base body 20, each of which is formed of a synthetic resin, and a wood part 30 made of a woody material.

The key base body 20 is comprised of a base end 21, and an extended part 22 formed integrally with the base end 21 and extending forward (toward the player) therefrom. The base end 21 is formed therein with a recessed part 21*f* open downward, and a pivot 23 is formed integrally with inner walls of the recessed part 21*f*. Further, as shown in FIG. 1C, the base end 21 has an upper surface 21*e* thereof formed therein with adhesive storage grooves 21*a* and 21*b* and grooves 21*c* and 21*d* for receiving sensor leads 14 used for detecting key depression.

As shown in FIGS. 1A and 1B, the wood part 30 has substantially the same length as the extended part 22 of the key base body 20, and is fixedly bonded to an upper surface 22*a* of the extended part 22. Between the wood part 30 and the base end 21, there is formed a clearance CL1 extending transversely of the key structure K1.

The clearance CL1 serves mainly to accommodate variations in the longitudinal dimensions of the wood part 30 and the key base body 20, and also to prevent degradation of the bonded state of the wood part 30 and the key base body 20 which is caused by expansion and contraction or deformation of the wood part 30 due to changes in the environment.

The upper plate body 10 has a playing or depressing surface 10*a*, and is slightly longer than the wood part 30. A rear part 11 of the upper plate body 10, which extends as a connecting part from a location slightly forward of the clearance CL1 to the rear end of the upper plate body 10, is formed therein with a through hole 11*a* through which a screw 13 is inserted and through holes 11*b* and 11*c* through which an adhesive is injected (see FIG. 1C). The upper plate body 10 is fixedly bonded to both an upper surface (upper part) 30*a* of the wood part 30 and the upper surface 21*e* of the base end 21 of the key base body 20. In addition, the rear part 11 of the upper plate body 10 is fixed to the base end 21 of the key base body 20 also by the screw 13.

More specifically, the wood part 30 is bonded to the key base body 20, and then the upper plate body 10 is placed over the key base body 20 and the wood part 30 from above with the adhesive applied between the upper surface 30*a* of the wood part 30 and the upper plate body 10. Thereafter, as shown in FIG. 1C, the screw 13 inserted through an engaging member 12 is inserted through the through hole 11*a* to be provisionally screwed into the base end 21. At the same time, portions, not shown, of the sensor leads 14 extending downward from the engaging member 12 are received in the grooves 21*c* and 21*d*. Then, the adhesive is injected through the through holes 11*b* and 11*c* to fill the adhesive storage grooves 21*a* and 21*b*, and the screw 13 is fully fastened, whereby assembly of the key structure K1 is completed. When the key structure K1 is mounted in a keyboard apparatus (such as a keyboard instrument), not shown, a front end K1*a* (player-side end) thereof is allowed to perform a vertical pivotal motion about the pivot 23.

The wood part 30 plays the role of making the key structure K1 present a woody appearance. When an adjacent key is depressed, a side surface of the key structure K1 is exposed to the view of the player. The wood part 30 made of a woody material is disposed such that it is visually recognized as part of a side of the key structure K1 when the adjacent key is depressed, so that the key structure K1 appears as if it were made of wood except for its upper and front surfaces. This makes the key structure K1 present a woody appearance, and hence a high-quality appearance.

The rear part 11 of the upper plate body 10 extends in a manner spanning the base end 21 and the wood part 30. A portion of the rear part 11 connecting between the base end 21 and the wood part 30 at a location above the clearance CL1 will be specifically referred to as "the bridge part 11Br". If the base end 21 and the wood part 30 were not connected by the bridge part 11Br, leaving the clearance CL1 open upward, the wood part 30 would be supported only by the key base body 20 in the vicinity of the clearance CL1. In this case, when the key is depressed, stress would be concentrated on a bridge part (clearance-neighboring part) 22Br, which is a part in the neighborhood of the clearance CL1, of the extended part 22 of the key base body 20, which makes the upper surface 22*a* of the extended part 22 of the key base body 20 and the wood part 30 liable to separation. In addition, the flexural rigidity of the whole key structure K1 would become low. In the present embodiment, however, since the base end 21 and the wood part 30 are fixedly connected by the rear part 11 of the upper plate body 10, separation is difficult to occur between the upper surface 22*a* of the extended part 22 and the wood part 30, and the vertical rigidity of a portion of the key structure between the base end 21 and the wood part 30, especially the vertical rigidity in the vicinity of the clearance CL1 is increased.

The extended part 22 of the key base body 20 is in the form of a thin plate which is vertically thin, and its vertical thickness is less than that of the rear part 11 of the upper plate body 10. Particularly because the bridge part 22Br is formed with a small thickness, the influence of vertical warpage of the key base body 20 caused by molding thereof on the whole key structure K1 can be reduced.

More specifically, the vertical thickness of the key base body 20 sharply changes in the vicinity of the boundary between the base end 21 and the extended part 22, and therefore the extended part 22 tends to become vertically warped about the boundary relative to the base end 21 when the key base body 20 is formed by molding. When the wood part 30 and the upper plate body 10 are mounted to the largely warped key base body 20, if the bridge part 22Br were formed with a large thickness, the key base body 20 would have its shape forcibly corrected, which produces a large residual stress in the key base body 20, resulting in distortion of the whole key structure K1 (by rebounding). In the present embodiment, however, the bridge part 22Br is formed with a small thickness, so that when the key structure K1 is assembled, the vertical deformation of the key base body 20 is easily corrected without producing a large residual stress, which makes it possible to reduce distortion of the key structure K1 after assembly. On the other hand, the rigidity of the whole key structure K1 is secured mainly by the bridge part 11Br, and therefore at least the bridge part 11Br is formed with a larger thickness than the bridge part 22Br such that it has a higher rigidity than the bridge part 22Br.

According to the present embodiment, the base end 21 and the wood part 30 are fixedly connected by the rear part 11 of the upper plate body 10 at a location above the clearance CL1. As a result, separation of the upper surface 22*a* of the extended part 22 of the key base body 20 from the wood part 30 can be prevented. In addition, the vertical rigidity of the key structure K1, especially in the vicinity of the clearance between the base end 21 and the wood part 30, can be increased. Further, since the bridge part 22Br is formed with a small thickness, distortion of the key structure K1 after assembly can be reduced.

Furthermore, the through holes 11*a*, 11*b* and 11*c* are formed in the rear part 11 of the upper plate body 10 for screw-fixing and adhesive injection, which makes it easy to secure the upper plate body 10 to the key base body 20 via other materials such as the screw 13 and the adhesive. The uses of the through holes formed through the rear part 11 of the upper plate body 10 are not limited to the above examples.

Although in the above described embodiment, the rear part 11 of the upper plate body 10 and the base end 21 of the key base body 20 are fixed to each other by both screw-fixing and bonding, this is not limitative, but only one of screw-fixing and bonding, or some other fixing means may be employed.

Figure 2A:
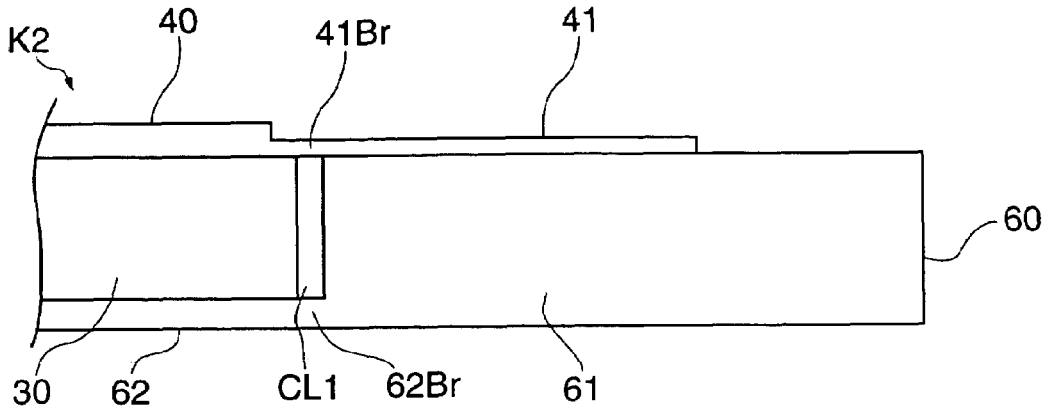
FIG. 2A is a right side view of a rear half of a key structure according to a second embodiment of the present invention.
Figure 2B:
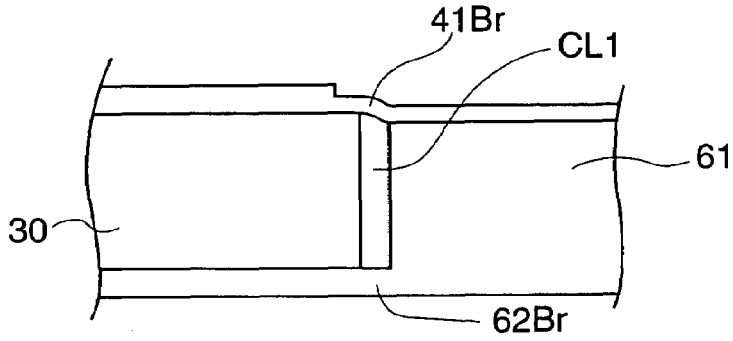
FIG. 2B is a right side view of a clearance and the neighborhood thereof in the key structure.
Figure 2C:
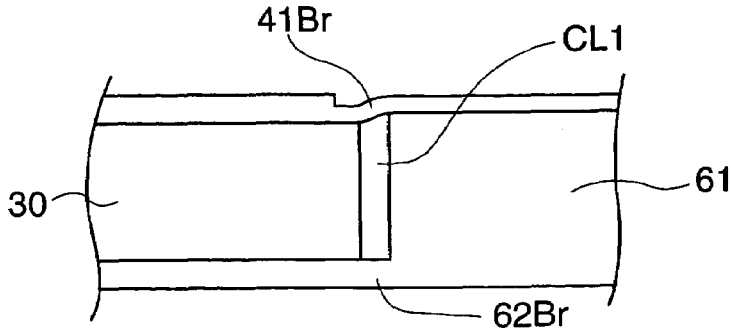
FIG. 2C is a right side view of the clearance and the neighborhood thereof in the key structure.

FIG. 2A is a right side view of the rear half of a key structure according to a second embodiment of the present invention. FIGS. 2B and 2C are right side views of a clearance and the neighborhood thereof in the key structure.

The key structure K2 according to the second embodiment is different in configuration from the key structure K1 according the first embodiment only in the shapes of an upper plate body and a key base body thereof. In FIGS. 2A to 2C, component elements corresponding to those shown in the first embodiment are designated by identical reference numerals. Through holes 11*a*, 11*b*, and 11*c* are not shown in the figures, but actually, they are provided as in the first embodiment.

As shown in FIG. 2A, in the key structure K2, an extended part 62 of the key base body 60 is formed with a larger thickness than the extended part 22 of the key base body 20 of the key structure K1. The extended part 62 has the same construction as the extended part 22 of the key base body 20 in the other respects. Similarly, the upper plate body 40 has the same construction as the upper plate body 10 of the key structure K1 except that the upper plate body 40 has a rear part 41 formed as a connecting part in the form of a thin plate. A wood part 30 and a base end 61 of the key base body 60 are fixedly connected by the rear part 41 of the upper plate body 40.

Comparing between a bridge part 41Br, which is a portion of the rear part 41 above the clearance CL1 (clearance-neighboring part), and a bridge part 62Br, which is a portion of the extended part 62 of the key base body 60 below the clearance CL1 (clearance-neighboring part), the bridge part 41Br is thinner than the bridge part 62Br, and therefore the vertical rigidity of the bridge part 41Br is sufficiently lower than that of the bridge part 62Br.

As described hereinabove, the wood part 30 changes in dimension due to environmental changes. For example, the wood part 30 expands under high humidity (see FIG. 2B) and contracts-under low humidity (see FIG. 2C). In the present embodiment, since the bridge part 41Br has a lower rigidity than the bridge part 62Br, even when the height of the wood part 30 changes as shown in FIGS. 2B and 2C, the bridge part 41Br can easily be deformed vertically so that deformation of the bridge part 62Br is almost avoided.

More specifically, the bridge part 41Br can accommodate a dimensional error or deformation of the wood part 30 to suppress deformation of the extended part 62 of the key base body 60. In many cases, although not shown, key functional parts, such as a key actuator, a key return spring, and a key operation guide, are provided for the key base body 60, and therefore deformation of the key base body 60 has to be avoided as much as possible so as to maintain accuracy of the key functional parts. According to the present embodiment, even if the bridge part 41Br has been deformed, the deformation of the rear part 41 of the upper plate body 40, which is an invisible part, does not affect the appearance at all and hardly affects the key functions, either. In view of this fact, the bridge part 41Br is designed to be more deformed for accommodation of the dimensional change of the wood part 30 to thereby maintain the key functions without affecting the appearance. This is also effective in accommodating a dimensional error of the wood part 30 due to manufacturing tolerances.

According to the present embodiment, it is possible not only to provide the same advantageous effects as provided by the first embodiment, that is, preventing separation between the key base body 60 and the wood part 30, and increasing vertical rigidity in the vicinity of the clearance between the base end 61 and the wood part 30 of the key structure K2, but also to enable the bridge part 41Br to accommodate a vertical dimensional error or change of the wood part 30 due to inaccuracy in machining or an environmental change, thereby suppressing deformation of the key base body 60, and hence deformation of the whole key structure K2.

Figure 3A:
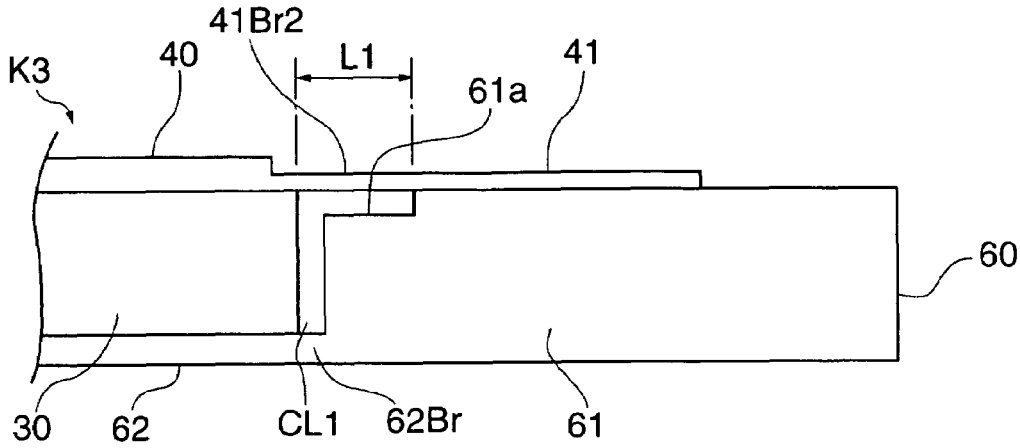
FIG. 3A is a right side view of a rear half of a key structure according to a third embodiment of the present invention.
Figure 3B:
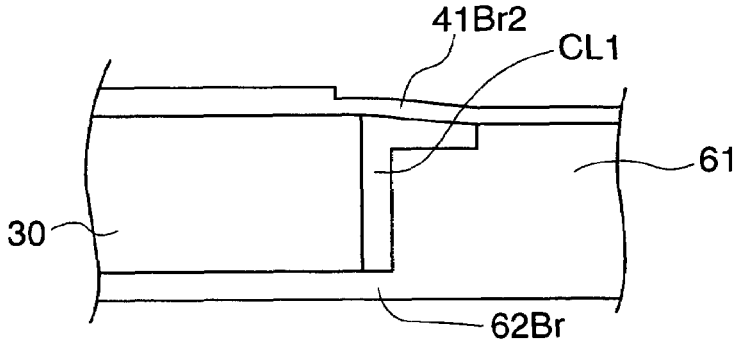
FIG. 3B is a right side view of a clearance and the neighborhood thereof in the key structure according to the third embodiment.
Figure 3C:
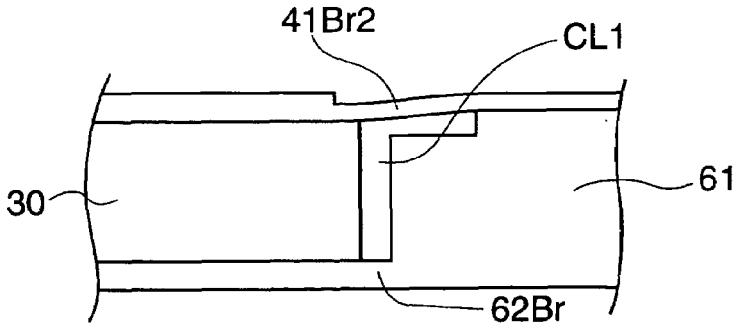
FIG. 3C is a right side view of the clearance and the neighborhood thereof in the key structure according to the third embodiment.

FIG. 3A is a right side view of the rear half of a key structure according to a third embodiment of the present invention. FIGS. 3B and 3C are right side views of a clearance and the neighborhood thereof in the key structure.

The key structure K3 according to the third embodiment is different in configuration from the key structure K2 according to the second embodiment only in that in the key structure K2 according to the second embodiment, the base end 61 of the key base body 60 is formed as a stepped part. In FIGS. 3A to 3C, component elements corresponding to those shown in the second embodiment are designated by identical reference numerals.

As shown in FIG. 3A, in the key structure K3, the upper front end of the base end 61 of the key base body 60 is formed as the stepped part 61*a*. A rear part 41 of an upper plate body 40 has a portion thereof rearward of the stepped part 61*a* fixed to the base end 61. Therefore, the rear part. 41 of the upper plate body 40 is not fixed to either the base end 61 or the wood part 30 in an area having a length L1 corresponding to the sum of the length of the clearance CL1 and that of the stepped part 61*a* of the rear part 41 in the longitudinal direction of the key structure K3. This area will be referred to as "the bridge part 41Br2". The length L1 of the bridge part 41Br2 is set according to the vertical thickness of the wood part 30. For example, the length L1 is set to be not less than a value (predetermined length) (e.g. 3 mm) corresponding to 30% of the vertical thickness of the wood part 30.

In the key structure K2 according to the second embodiment, the bridge part 41Br of the rear part 41 of the upper plate body 40 has only a length corresponding to that of the clearance CL1 in the longitudinal direction of the key structure K2, and therefore, when deformed vertically, the bridge part 41Br slightly bends into a small S shape in side view. Consequently, a reaction force of the bridge part 41Br is applied to the base end 61 and the wood part 30, which can cause destruction of the bridge part 41Br or deformation of the key structure K2 e.g. into a shape having its rear end bent upward. On the other hand, the key structure K3 according to the third embodiment has the bridge part 41Br2 formed with the length L1 larger than that of the clearance CL1 in the longitudinal direction of the key structure K2, and therefore, as shown in FIGS. 3B and 3C, the S-shaped warpage of the bridge part 41Br2 caused when the height of the wood part 30 changes can be made gentler than that of the key structure K2. Thus, the present embodiment makes it possible to reduce distortion or warpage of the key structure K3.

According to the present embodiment, it is possible not only to provide the same advantageous effects as provided by the second embodiment, but also to reduce deformation of the bridge part 41Br2 of the upper plate body 40 which is bent so as to accommodate a vertical dimensional error or change of the wood part 30, to thereby further reduce distortion or warpage of the key structure K3.

Figure 4A:
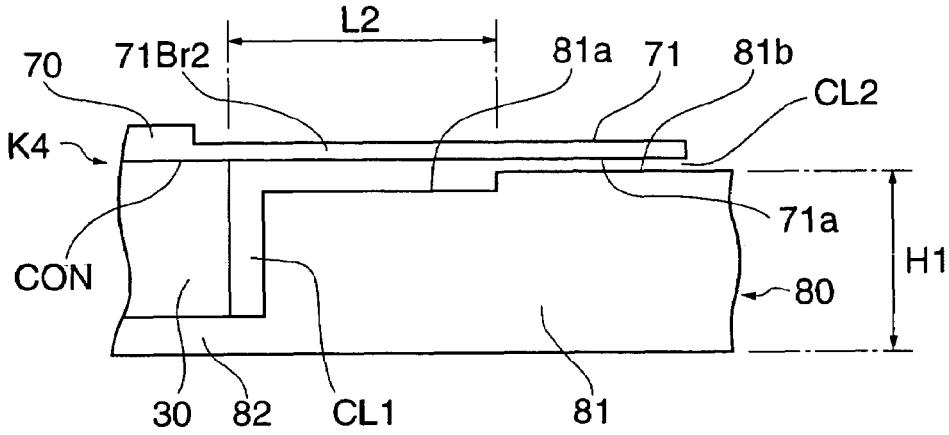
FIG. 4A is a right side view of a clearance and the neighborhood thereof in a rear half of a key structure according to a fourth embodiment of the present invention (in a state where a rear part of an upper plate body has not been fixed yet)
Figure 4B:
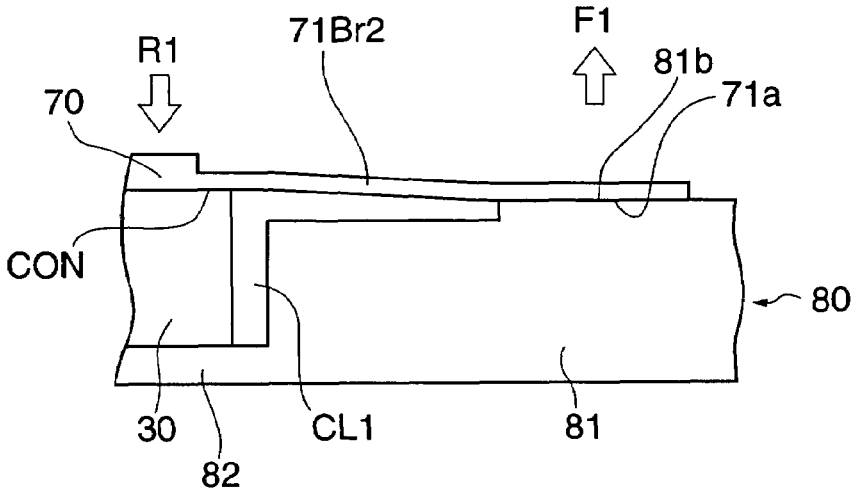
FIG. 4B is a right side view of the clearance and the neighborhood thereof in the rear half of the key structure according to the fourth embodiment (in a state where the rear part of the upper plate body has already been fixed)

FIGS. 4A and 4B are right side views of a clearance and the neighborhood thereof in the rear half of a key structure according to a fourth embodiment of the present invention. FIG. 4A shows the rear part of an upper plate body that has not been fixed yet, while FIG. 4B shows the same that has already been fixed.

The key structure K4 according to the fourth embodiment is basically different from the key structure K3 according to the third embodiment in the thickness of a base end of a key base body thereof and the length of a stepped part of the base end.

First, let it be assumed that the upper plate body 70 is configured similarly to the upper plate body 40, and the rear part 71 of the upper plate body 70, as a connecting part, is formed by molding in a manner extending ideally straight rearward from the front half of the upper plate body 70. On the other hand, the upper front end of the base end 81 of the key base body 80 is formed as a stepped part 81*a*. The thickness (height) H1 of a portion of the base end 81, rearward of the stepped part 81*a*, is less than that of the corresponding portion of the key base body 60 in the key structure K3. The key base body 80 has the same configuration as the key base body 60 except for the above points. An opposed surface (opposed part) 81*b*, which is a part of the upper surface of the base end 81, and an opposed surface (opposed part) 71*a*, which is a part of the lower surface of the rear part 71, are bonded to each other for assemblage. When assembling them, in a state where the upper plate body 70 is secured only to the wood part 30 under a normal environment with normal temperature and normal humidity, a vertical clearance CL2 is formed between the opposed surfaces 71*a* and 81*b* due to the small height of the base end 81. More specifically, the upper surface of the wood part 30 whose thickness (height) changes with a change in temperature or humidity is positioned at a level higher than the opposed surface 81*b* of the base end 81 under the normal environment, as shown in FIGS. 4A and 4B.

Assembly of the key structure K4 is performed as follows: First, the wood part 30 is fixedly bonded to the extended part 82 of the key base body 80, and the upper plate body 70 is fixedly bonded to the wood part 30. Then, the opposed surface 81*b* of the base end 81 and the opposed surface 71*a* of the rear part 71 are fixed to each other as shown in FIG. 4B, whereby the assembly of the key structure K4 is completed. The fixing of the opposed surfaces 81*b* and 71*a* is achieved by bonding and screw-fixing as in the first to third embodiments. A bridge part 71Br2 of the rear part 71 as an area having a length L2 corresponding to the sum of the length of the clearance CL1 and that of the stepped part 81*a* in the longitudinal direction of the key structure K4 is not fixed to either the base end 81 or wood part 30.

In the key structure K4 after the assembly, the upper surface of the wood part 30 is positioned at a level higher than the opposed surface 81*b* of the base end 81 under the normal environment, and therefore a tensile force F1 that causes the opposed surface 71*a* to pull the opposed surface 81*b* upward is generated. Further, in a manner balancing with the tensile force F1, an urging force R1 that causes the upper plate body 70 to urge the wood part 30 is generated between the wood part 30 and the upper plate body 70, especially at a bonded part CON of the rear part.

The upper plate body 70 and the key base body 80 are both made of synthetic resin, so that the bonding strength of the two opposed surfaces 71*a* and 81*b* bonded together by an adhesive is high. On the other hand, the bonding strength of the wood part 30 and the upper plate body 70 bonded together by an adhesive is low. Therefore, it is important how to prevent the wood part 30 and the upper plate body 70 from being separated especially at the bonded part CON of the rear part when a dimensional change of the wood part 30 occurs due to an environmental change. This problem can be solved, as described below with reference to FIGS. 5A to 5F, by configuring the key structure K4 such that the clearance CL2 is formed before assembly under the normal environment.

Figure 5A:
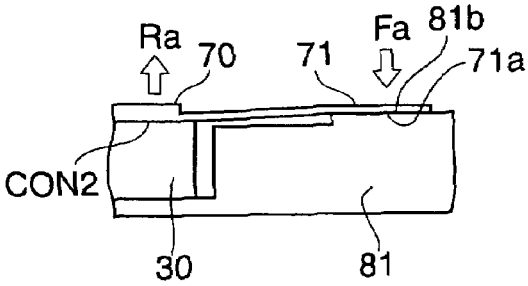
Figure 5D:
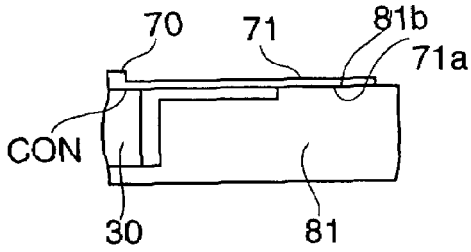
Figure 5B:
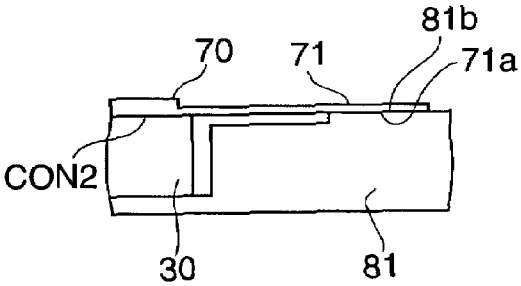
Figure 5E:
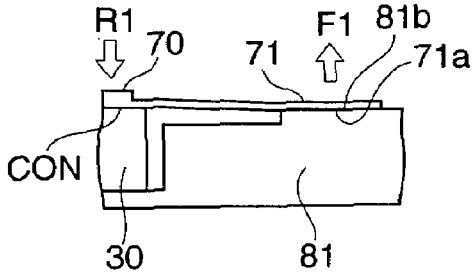
Figure 5C:
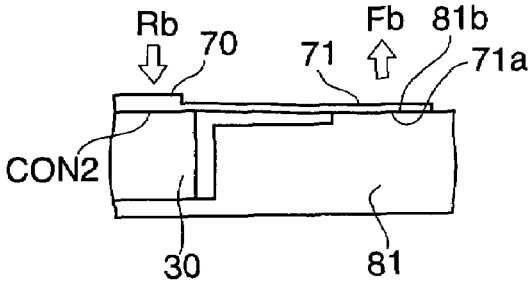
Figure 5F:
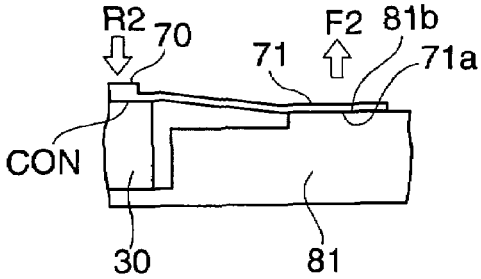

FIGS. 5A to 5F are right side views of the clearances and the neighborhood thereof in key structures, which shows the relationship between dimensional changes of the wood part 30 due to environmental changes and reaction forces generated at the bonded parts. FIGS. 5A to 5C show a key structure which is configured such that the clearance CL2 is not formed under the normal environment. FIGS. 5D to 5F show the key structure K4 (configured to have the clearance CL2 under the normal environment) according to the present embodiment. FIGS. 5A and 5D show states under a low humidity environment, FIGS. 5B and 5E states under the normal environment, and FIGS. 5C and 5F states under a high humidity environment.

With the configuration shown in FIGS. 5A to 5C, under the normal environment, as shown in FIG. 5B, almost no tensile force or urging force is generated at the opposed surface 71*a* and the bonded part CON2. Under the high humidity environment, the wood part 30 expands, and consequently, as shown in FIG. 5C, an upward tensile force Fb acting on the opposed surface 81*b* is generated at the opposed surface 71*a*, and an urging force Rb that causes the upper plate body 70 to urge the wood part 30 is generated at the bonded part CON2. On the other hand, under the low humidity environment, the wood part 30 contracts, and the position of the upper surface of the wood part 30 becomes lower than that of the opposed surface 81*b* of the base end 81 as shown in FIG. 5A, so that an urging force Fa is generated at the opposed surface 71*a* and a tensile force Ra at the bonded part CON2. The generation of this tensile force Ra is likely to cause separation of the upper plate body 70 from the wood part 30 at the bonded part CON2 where the bonding strength is weak.

On the other hand, in the key structure K4 according to the present embodiment, under the normal environment, the tensile force F1 is generated at the opposed surface 71*a*, and the urging force R1 at the bonded part CON, as shown in FIGS. 4B and 5E. Under the high humidity environment, the wood part 30 expands, which causes generation of a tensile force F2 (F2>F1) at the opposed surface 71*a* and generation of an urging force R2 (R2>R1) at the bonded part CON, as shown in FIG. 5F. Under these conditions, only the urging forces are generated at the bonded part CON, and therefore, there is no fear that a tensile force may cause separation at the bonded part CON.

On the other hand, as shown in FIG. 5D, when the wood part 30 contracts under the low humidity environment, making the upper surface of the wood part 30 almost flush with the opposed surface 81*b* of the base end 81, almost no tensile force or urging force is generated at the opposed surface 71*a* and the bonded part CON. Particularly because no tensile force is generated at the bonded part CON even under the low humidity environment, separation of the wood part 30 from the upper plate body 70 is prevented.

From the viewpoint of reduction of the tensile force and the urging force, it is preferred that the length L2 of the bridge part 71Br2 (see FIG. 4B), which deforms so as to accommodate a dimensional change of the wood part 30, is set to be sufficiently large mainly in consideration of the state under the high humidity environment. For example, the length L2 is set to approximately 16 mm.

According to the present embodiment, it is possible not only to provide the same advantageous effects as provided by the third embodiment, but also to suppress generation of a large force (tensile force) acting between the wood part 30 and the upper plate body 70 in a direction in which the upper plate body 70 is separated from the wood part 30, even when the vertical thickness of the wood part 30 increases due to an environmental change, to thereby prevent separation between the wood part 30 and the upper plate body 70 at the bonded part CON.

Although in the present embodiment, the rear part 71 of the upper plate body 70 is formed to extend straight by molding, this is not limitative, but the rear part 71 may be formed to bend upward or downward. More specifically, the height H1 of the rear end of the base end 80 may be set depending on the degree of bending of the rear part 71 to thereby configure the key structure K4 such that a force that causes the opposed surface 71*a* of the rear part 71 to pull the opposed surface 81*b* of the base end 81 is generated after completion of assembly of the key structure K4 under the normal environment. It is preferred that the height H1 is set such that no tensile force, or only a small tensile force, if any, is generated at the bonded part CON under low humidity conditions that can be expected.

In the above described embodiments, the connecting part that fixedly connects the wood part and the base end of the key base body is formed integrally with the upper plate body. In the first embodiment, for example, the rear part 11 of the upper plate body 10 is formed integrally with the upper plate body 10. However, this is not limitative, but the connecting part may be implemented by a member separate from the upper plate body 10 insofar as the member includes a part corresponding to the bridge part 11Br, for example. Now, this alternative will be explained by referring to variations of the key structure K4 of the fourth embodiment.

Figure 6A:
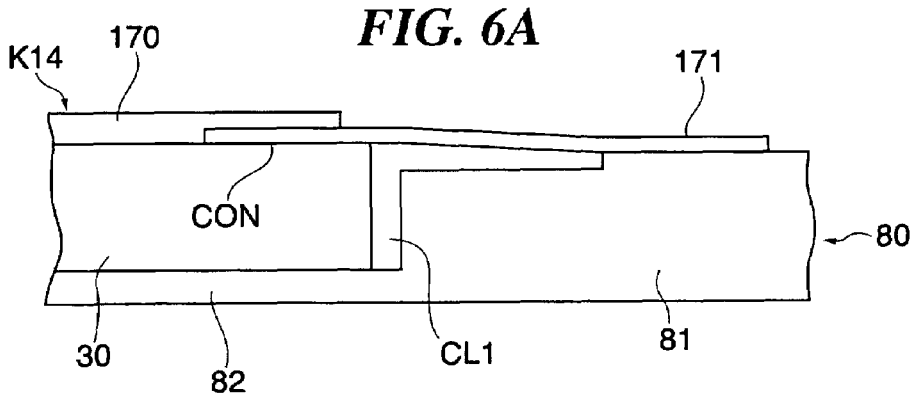
FIG. 6A is a right side view of a clearance and the neighborhood thereof in a rear half of a key structure according to a first variation of the fourth embodiment.

FIG. 6A is a right side view of a clearance and the neighborhood thereof in the rear half of a key structure according to a first variation of the fourth embodiment.

As is apparent from a comparison between FIG. 4B and FIG. 6A, in the key structure K14, shown in FIG. 6A, of the first variation of the fourth embodiment, an upper plate body 170 corresponding to the upper plate body 70 without the rear part 71, and a connecting part 171 corresponding to the rear part 71 of the upper plate body 70 are formed as two separate members, and the front part of the connecting part 171 is fixedly bonded to the wood part 30 at the bonded part CON. Further, the upper plate body 170 is not only bonded to the wood part 30, but the rear part thereof is bonded to a front upper surface of the connecting part 171. With this configuration, it is possible to provide the same advantageous effects as provided by the key structure K4 of the fourth embodiment.

Figure 6B:
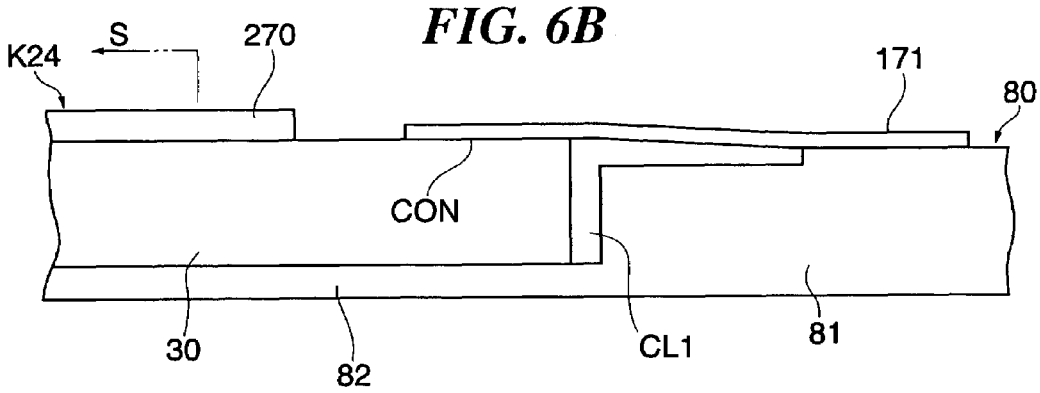
FIG. 6B is a right side view of a clearance and the neighborhood thereof in a rear half of a key structure according to a second variation of the fourth embodiment.

FIG. 6B is a right side view of a clearance and the neighborhood thereof in the rear half of a key structure according to a second variation of the fourth embodiment.

As shown in FIG. 6B, the length of the whole key structure K24 according to the second variation is larger than that of the whole key structure K14, and therefore a wood part 30 of the key structure K24 is also correspondingly longer than that of the key structure K14. When the elongated key structure K24 for use as a piano key or the like is configured to have an upper plate body and a connecting part as separate members, the upper plate body 270 and the connecting part 171 may be arranged in a manner spaced from each other in the longitudinal direction of the key structure K24, and both bonded to the wood part 30, as shown in FIG. 6B. The connecting part 171 is positioned rearward of the upper plate body 270 and over the clearance CL1 to hold the wood part 30 and the base end 81 of the key base body 80 in a fixed state. When this configuration is adopted, it is possible to employ the same upper plate body 270 for a plurality of key structures different in length from the key structure K24. In other words, the upper plate body 270 can be shared for use among a plurality of models. A visible area S (see FIG. 6B) is on the upper plate body 270, and the connecting part 171 does not belong to the visible area S. Therefore, while the upper surface of the upper plate body 270 needs to be finished with high quality, the upper surface of the connecting part 171 may be left roughly machined or formed of a non-high-quality material. This makes it possible to save machining costs and material costs, compared with the configuration in which the upper plate body and the connecting part are formed integrally as one piece. This advantageous effect can also be provided by the key structure K14 shown in FIG. 6A insofar as the connecting part 171 does not belong to the visible area S.

From the viewpoint of prevention of separation between a key base body and a wood part and enhancement of vertical rigidity in the vicinity of a clearance in a key structure having a clearance provided between the base end of the key base body and the wood part, the clearance is not necessarily required to extend through the key structure in the transverse direction of the key. Now, this alternative will be explained by referring to another variation of the key structure K4 of the fourth embodiment.

Figure 6C:
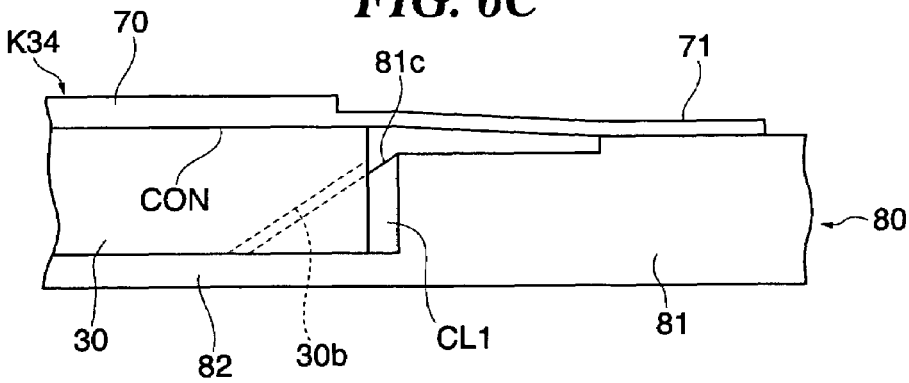
FIG. 6C is a right side view of a clearance and the neighborhood thereof in a rear half of a key structure according to a third variation of the fourth embodiment.

FIG. 6C is a right side view of a clearance and the neighborhood thereof in the rear half of a key structure according to a third variation of the fourth embodiment.

As is apparent from a comparison between FIG. 4B and FIG. 6C, the key structure K34 according to the third variation has a key base body 80 formed integrally with a protrusion 81*c* that has a triangular shape in side view and connects between the front end of the base end 81 and the upper rear part of an extended part 82. The protrusion 81*c* has opposite sides thereof extending substantially in parallel with each other in the longitudinal and vertical directions of the key structure K34, for example, but the opposite sides thereof are not necessarily required to be parallel in the two directions. On the other hand, the wood part 30 is formed therein with a groove-like recess 30*b* shaped to fit on the associated protrusion 81*c*. Before the wood part 30 is fixedly bonded to the upper surface of the extended part 82 of the key base body 80, the protrusion 81*c* is fitted into the groove-like recess 30*b*. According to this configuration of the key structure K34, combined with the fixed connection of the base end 81 of the key base body 80 and the wood part 30 at a location above the clearance CL1 by the rear part 71 of the upper plate body 70 as the connecting part, the provision of the protrusion 81*c* makes it possible to prevent separation between the key base part 80 and the wood part 30 more effectively, and enhance the vertical rigidity of the key structure K34 in the vicinity of the clearance CL1 more effectively.

Although the configurations shown in FIGS. 6A to 6C have been described as variations of the fourth embodiment, they may also be applied to the key structures K1 to K3 according to the first to third embodiments.

What is claimed is:

1. A key structure that functions as a key when mounted in a keyboard apparatus, comprising:

a player-side end that is pivotally moved by key depression;

a key base body that has an elongated shape, said key base body having a base end, and an extended part formed integrally with said base end and extended therefrom toward the player, said extended part having an upper part;

a wood part that is fixed to said upper part of said extended part of said key base body, in a manner such that a clearance is formed transversely of said key base body between said wood part and said base end of said key base body, said wood part having an upper part, the wood part having substantially the same length as the extended part of the key base body;

an upper plate body that is fixed to said upper part of said wood part, said upper plate body having a depressing surface; and a connecting part that is located above the clearance, wherein said base end of said key base body and said upper plate body are fixedly connected to each other via said connecting part.

2. A key structure as claimed in claim 1, wherein said extended part of said key base body has at least a part thereof in a neighborhood of the clearance, said part being formed with a thickness smaller than a thickness of said connecting part.

3. A key structure as claimed in claim 1, wherein said connecting part and said extended part of said key base body have respective parts thereof in a neighborhood of the clearance, said part in the neighborhood of the clearance, of said connecting part having a vertical rigidity lower than a vertical rigidity of said part in the neighborhood of the clearance, of said extended part.

4. A key structure as claimed in claim 1, wherein said part in the neighborhood of the clearance, of said connecting part has an area that is not fixed to said base end of said key base body, the area having a length in a longitudinal direction of the key structure which is not less than a predetermined length according to a vertical thickness of said wood part.

5. A key structure as claimed in claim 1, wherein said connecting part has an opposed part, and said base end of said key base body has an opposed part corresponding to said opposed part of said connecting part, said key base body, said upper plate body, and said connecting part being all formed of a synthetic resin, and wherein said wood part, said connecting part, said key base body, said upper plate body, and said connecting part are configured such that under a normal environment with normal temperature and normal humidity, when said connecting part is fixed to said wood part, and at a same time said connecting part and said base end of said key base body are not fixed to each other, a vertical clearance is formed between said opposed part of said connecting part and said opposed part of said base end, and when said opposed part of said connecting part and said opposed part of said base end are brought into a state fixed to each other, a tensile force that causes said opposed part of said connecting part to pull said opposed part of said base end is generated under the normal environment.

6. A key structure as claimed in claim 1, wherein said base end of said key base body and said connecting part are fixed to each other, said connecting part having formed therein through holes vertically extending through a portion of said connecting part fixed to said base end.

7. A key structure as claimed in claim 1, wherein said connecting part is formed integrally with said upper plate body.

8. A key structure as claimed in claim 1, wherein said connecting part is formed separately from said upper plate body.

9. A key structure that functions as a key when mounted in a keyboard apparatus, comprising:

a player-side end that is pivotally moved by key depression;

a key base body that has an elongated shape, said key base body having a base end, and an extended part formed integrally with said base end and extended therefrom toward the player, said extended part having an upper part;

a wood part that is fixed to said upper part of said extended part of said key base body, in a manner such that a clearance is formed transversely of said key base body between said wood part and said base end of said key base body, said wood part having an upper part;

an upper plate body that is fixed to said upper part of said wood part, said upper plate body having a depressing surface; and a connecting part that is located rearward of said upper plate body and above the clearance, said connecting part being formed separately from said upper plate body, wherein said wood part and said base end of said key base body are fixedly connected to each other via said connecting part.

* * * * *